US005683187A

United States Patent [19]

Tunmore

[11] Patent Number: 5,683,187

[45] Date of Patent: Nov. 4, 1997

[54] DIGITAL COLOR PRESS PLATEN ASSEMBLY WITH PIVOTING PLATEN FRAME

[75] Inventor: David F. Tunmore, Xenia, Ohio

[73] Assignee: Scitex Digital Printing, Inc.

[21] Appl. No.: 665,490

[22] Filed: Jun. 18, 1996

[51] Int. Cl.[6] ..... B41J 11/20

[52] U.S. Cl. ..... 400/58; 400/82

[58] Field of Search ..... 400/55, 56, 57, 400/58, 59, 625, 60, 82

[56] References Cited

U.S. PATENT DOCUMENTS

| | | | |
|---|---|---|---|
| 4,575,267 | 3/1986 | Brull | 400/56 |
| 5,118,208 | 6/1992 | Kitahara et al. | 400/56 |
| 5,226,743 | 7/1993 | Jackson et al. | 400/625 |
| 5,316,395 | 5/1994 | Imai | 400/58 |
| 5,366,301 | 11/1994 | Martin et al. | 400/56 |

*Primary Examiner*—Christopher A. Bennett
*Attorney, Agent, or Firm*—Barbara Joan Haushalter

[57] ABSTRACT

A platen assembly is provided for use with a printing system which uses ink jet technology to produce images on a substrate. A platen and the substrate move together as a unit. One or more print rollers deflect the substrate under tension to maintain a stable substrate, critical for maintaining print quality. A pivot point is provided from which the rollers can be cantilevered away. A lifting mechanism is then used to raise and lower the platen and the substrate to and away from a print position.

8 Claims, 2 Drawing Sheets

DIGITAL COLOR PRESS PLATEN ASSEMBLY WITH PIVOTING PLATEN FRAME

TECHNICAL FIELD

The present invention relates to ink jet printing and, more particularly, to a printing platform that can be moved away from a specified print position and back into the same position.

BACKGROUND ART

In continuous ink jet printing, ink is supplied under pressure to a manifold region that distributes the ink to a plurality of orifices, typically arranged in a linear array(s). The ink discharges from the orifices in filaments which break into droplet streams. The approach for printing with these droplet streams is to selectively charge and deflect certain drops from their normal trajectories. Graphic reproduction is accomplished by selectively charging and deflecting drops from the drop streams and depositing at least some of the drops on a print receiving medium while other of the drops strike a drop catcher device. The continuous stream ink jet printing process is described, for example, in U.S. Pat. Nos. 4,255,754; 4,698,123 and 4,751,517, the disclosures of each of which are totally incorporated herein by reference.

Full color graphics printing with such continuous ink jet systems is being developed and practiced by Scitex Digital Printing, Inc., in Dayton, Ohio. One challenge with developing a digital color press is to allow accurate repositioning of the substrate relative to the printhead(s).

It is seen then that there is a need for a stable printing surface that maintains a desired gap between the printhead (s) and the substrate during printing, but allows for movement of the substrate away from the printhead(s) and accurate repositioning when necessary.

SUMMARY OF THE INVENTION

This need is met by the platen assembly according to the present invention, wherein a printing platform is provided that can be moved away from a specified print position and then returned to the same position. In the digital color press, it is necessary to decrease the gap between the printheads and the substrate as compared to previously manufactured printers. In, for example, a nine inch printhead, as developed and manufactured by Scitex Digital Printing, Inc., the size of the print jets have been reduced. This results in a reduced ink droplet size. This, in turn, dictates that the gap be reduced as much as possible because of the flight dynamics of the smaller drops.

A specific gap has been determined to be the optimum printhead clearance above the printing substrate for print quality. Because this gap is a fixed distance above the substrate regardless of the substrate caliper, it is possible that in cases of medium to heavy calipers, a splice in the web could cause damage to the printhead and/or web as it passes beneath. Because of the number of potential printing positions (up to 24 printheads) per system, it is more desirable to lower the substrate and reposition it to fixed stops than to move each printhead. Detection or notification of a downstream splice would initiate a movement of the platen away from the printhead(s) allowing sufficient clearance for the splice to pass.

In accordance with one aspect of the present invention, a platen assembly comprises a frame for housing a pair of printing rollers. Within the frame, the printing rollers are cantilevered away from a pivoting location. A lifting mechanism is positioned as far from the pivot point as possible to achieve maximum mechanical advantage. The platen frame assembly resides within a print module frame structure that supports the printhead(s).

It is an object of the present invention to provide a printing platform for a digital color press printing system. It is a further object of the present invention to provide such a printing platform, wherein the platform can be moved away from a specified print position, and then returned to the exact specified position.

Other objects and advantages of the invention will be apparent from the following description and the appended claims.

DETAILED DESCRIPTION OF THE INVENTION

Figure 1:
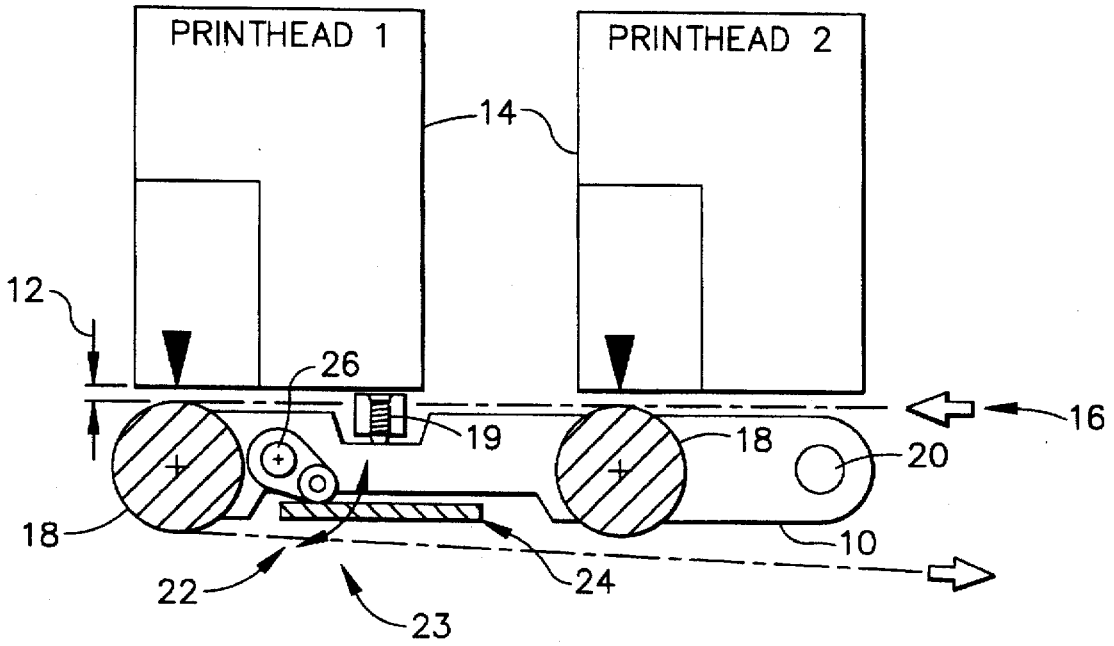
FIG. 1 illustrates the platen assembly of the present invention in a print position.

Printing systems using ink jet technology produce images on a web, usually paper. The system employs any of a variety of sized printheads, such as, for example, 4.27 inches (10.8 centimeters), 9.06 inches (23.1 centimeters), (10.7 inches (27.1 centimeters), or 13.3 inches (33.8 centimeters) wide. The printing system can print anywhere on a document, using a variety of type styles, point sizes, ink colors, and special effects.

Images are formed on the web by individual drops of ink released by a printhead at a density of 120 drops per inch or 240 drops per inch. The printing system uses continuous jet technology, in which the printhead releases a continuous stream of ink drops. Drops that are needed to form an image fall onto the web, while drops that are not needed receive an electric charge and are deflected into a catcher, for recirculation.

Imaging in the digital color press, as developed and manufactured by Scitex Digital Printing, Inc., is typically accomplished using four separate and independent printheads. Each head images a, different one of the primary colors, cyan, magenta, yellow or black. The printheads are of the binary, continuous ink jet type, and employ planar charging technology known in the art.

In a preferred embodiment of the present invention, imaging is done on a continuous web of paper. The various color heads are positioned behind each other so that they image sequentially on the paper as it passes underneath the head. In order to obtain high quality color images, multiple drops of each color ink are printed at each pixel location. The jet spacing is 240 dots per inch (dpi) with an orifice diameter of 0.7 mil. The stimulation frequency is 100 kHz and all heads are synchronized. The web speed is typically 200 feet per minute accurately controlled.

Figure 2:
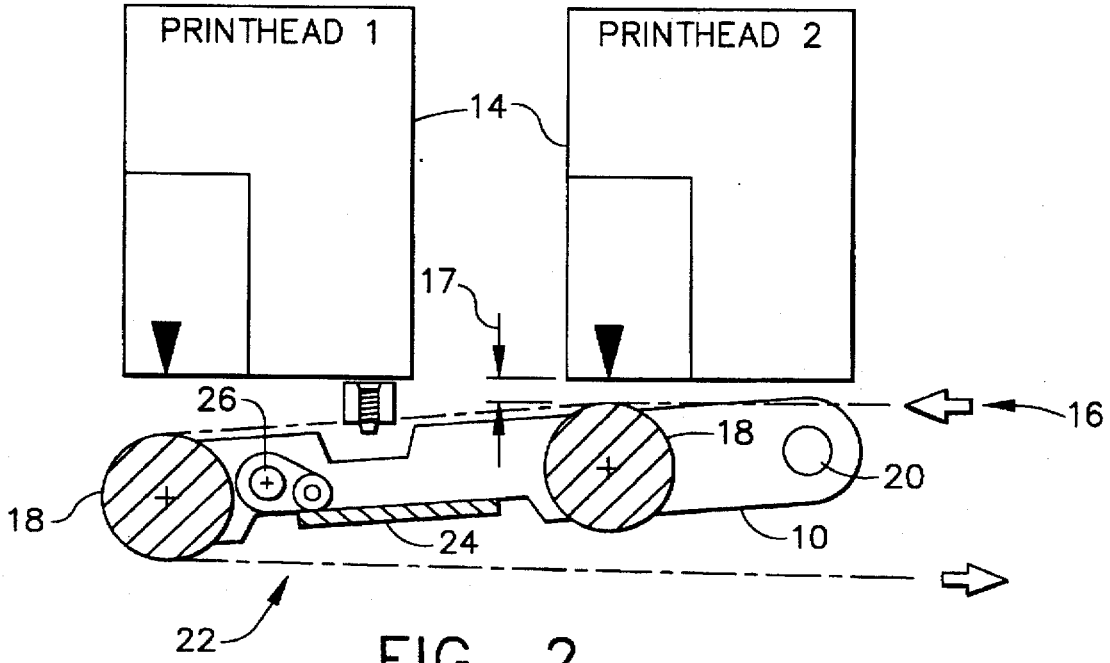
FIG. 2 illustrates the platen assembly of the present invention in a removed position.

Referring now to the drawings, FIG. 1 illustrates a platen assembly 10, in accordance with the present invention, situated in a print position; and FIG. 2 illustrates the platen assembly 10 in a removed position, i.e., removed from the specified print position. The platen assembly 10 provides a stable printing surface that maintains a desired print gap 12 between printhead 14 and substrate 16 during printing, but can allow the substrate 16 to be moved away from the printheads 14, as shown in FIG. 2, and later accurately repositioned, as in FIG. 1. The substrate, then, moves as a unit with the platen.

A specific gap 12 has been determined to be the optimum printhead clearance above the printing substrate for print quality. The gap remains constant because it relates to the drop size and time of flight of the drops. In a preferred embodiment, the optimum print gap is in the range of approximately 0.020 to 0.030 inches, and can be set by any suitable means, such as a gauge used at the printhead installation. For any particular application, the gap 12 is a fixed distance above the substrate 16, regardless of the substrate caliper, i.e., the thickness of the substrate. It is possible that in cases of medium to heavy calipers, a splice in the web could cause damage to the printhead and/or web as it passes beneath. Because of the number of potential printing positions (up to 24 printheads) per system, it is more desirable to lower the substrate, allowing sufficient clearance 17 for the splice to pass, and then reposition the substrate to stop means 19, than to move each printhead. The stop means 19 can be fixed stops, or adjustable stops that have been locked into position once the desired gap 12 has been established.

Figure 3:
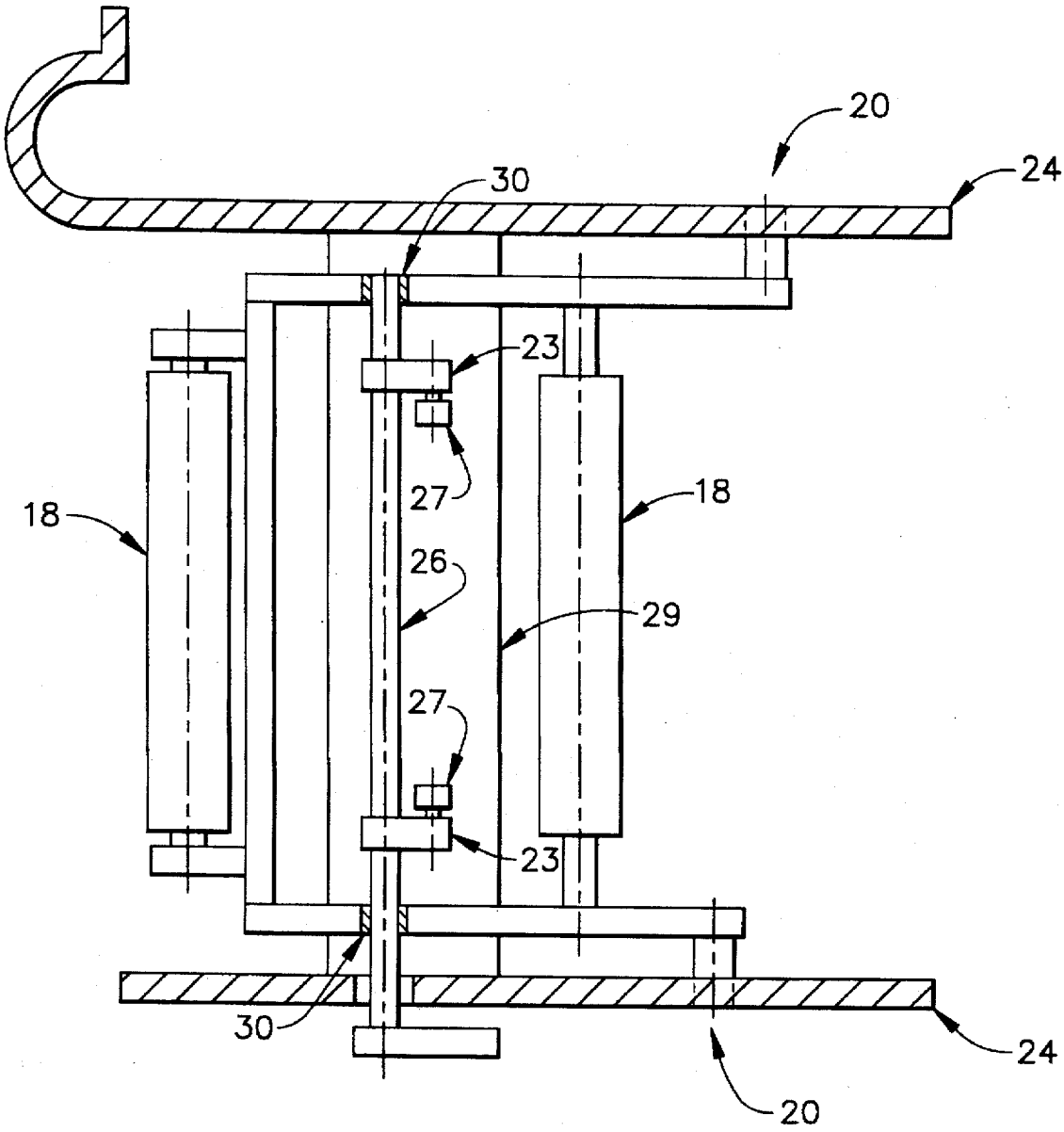
FIG. 3 is a top view of the print module with the printheads removed for clarity.

Continuing with FIG. 1 and 2, and also referring to FIG. 3, the platen assembly houses printing rollers 18. The printing rollers 18 are capable of being cantilevered away from a pivoting location 20. In a preferred embodiment of the present invention, a lifting mechanism 22 is positioned as far from the pivot point 20 as possible, to achieve maximum mechanical advantage. The lifting mechanism is preferably comprised of an eccentric height adjustment 23. The eccentric height adjustment is comprised of a cantilevered bearing 27 that rotates about shaft 26 and rides on a crossmember component 29 of a print module frame structure 24. The platen assembly 10 resides within the print module frame structure 24 that supports the printheads 14. The pivot point of the platen is fixed to sides of the print module frame structure 24. A shaft 26 runs through the eccentric height adjustment 23 and is fixed into bearings 30 on each side of the platen assembly. The shaft 26 is rotated mechanically, which drives bearing 27 against the print module frame crossmember. Because of the cantilevered nature of bearing 27, it raises and lowers the platen assembly, based on the amount of shaft 26 rotation.

Rotation of a shaft 26 fixed to the platen assembly 10 drives two eccentric cams 23 mounted to the shaft 26 against features in the print module frame 24. This action raises or lowers the platen assembly 10, by any suitable means, such as a lever driven by an air cylinder. The print module frame allows for repeatable repositioning in the printing (up) position illustrated in FIG. 1. The platen rotates freely up to the stop, returning the platen assembly and substrate to the correct position.

INDUSTRIAL APPLICABILITY AND ADVANTAGES

The present invention is useful in the field of ink jet printing, and has the advantage of allowing the substrate to be moved in and out of position. The present invention has the further advantage of returning the substrate to its original position, after it has been moved out of a print position. The present invention is particularly useful with a digital color press printing system, which requires a particularly narrow gap between the printheads and the substrate.

The invention has been described in detail with particular reference to certain preferred embodiments thereof, but it will be understood that modifications and variations can be effected within the spirit and scope of the invention.

I claim:

1. A platen assembly for use with a printing system using ink jet technology to produce images on a continuous web substrate, the assembly comprising:

a platen;

a platen frame associated with the platen for providing a stable printing surface;

at least one print roller housed within the platen frame for deflecting the continuous web substrate under tension;

a pivot point from which the at least one roller is cantilevered away;

a lifting mechanism for raising and lowering the platen frame and the substrate to and away from a print position.

2. A platen assembly as claimed in claim 1 further comprising at least one printhead for releasing ink for printing on the substrate.

3. A platen assembly as claimed in claim 2 wherein the at least one printhead comprises a plurality of printheads positioned one behind another to image sequentially as the substrate passes underneath each printhead.

4. A platen assembly as claimed in claim 2 further comprising a print gap between the at least one printhead and the substrate.

5. A platen assembly as claimed in claim 4 wherein the print gap is maintained during printing operation of the printing system.

6. A platen assembly as claimed in claim 4 further comprising a removed gap between the at least one printhead and the substrate, wherein the print gap is smaller than the removed gap.

7. A platen assembly as claimed in claim 1 wherein the lifting mechanism comprises stop means for positioning the platen and the substrate.

8. A platen assembly as claimed in claim 1 wherein the substrate is deflected around a circumference of the at least one roller.

* * * * *